United States Patent [19]

Vancil

[11] Patent Number: 4,681,370

[45] Date of Patent: Jul. 21, 1987

[54] ADJUSTABLE HEADREST FOR SUNBATHERS

[76] Inventor: David W. Vancil, 21031 Parthenia St., Canoga Park, Calif. 91304

[21] Appl. No.: 16,630

[22] Filed: Feb. 19, 1987

[51] Int. Cl.[4] ..... A47C 7/36

[52] U.S. Cl. ..... 297/405; 5/440; 248/118; 297/408

[58] Field of Search ..... 297/405, 408, 391; 5/437, 440; 248/118, 181

[56] References Cited

U.S. PATENT DOCUMENTS

| | | | |
|---|---|---|---|
| 361,906 | 4/1887 | Stiles | 297/405 X |
| 1,515,886 | 11/1924 | Rumsey | 5/437 X |
| 2,197,343 | 4/1940 | Marx | 5/440 |
| 2,469,859 | 5/1949 | Charbeneau | 248/181 X |
| 2,630,288 | 3/1953 | Eubanks | 248/118 |
| 2,795,838 | 6/1957 | McNeely | 5/437 X |
| 2,825,069 | 3/1958 | Jorgensen et al. | 248/118 |
| 2,908,519 | 10/1959 | Holden | 248/181 |
| 4,389,740 | 6/1983 | Henry | 248/118 |
| 4,501,080 | 2/1985 | Rich | 248/181 X |

*Primary Examiner*—Francis K. Zugel

*Attorney, Agent, or Firm*—Roger A. Marrs

[57] ABSTRACT

A sunbather's aid is disclosed herein for supporting the head of the user which includes a stationary base having a universal joint movably carrying a headrest platform. The platform is characterized as an oval-shaped headrest with a cushioned surface and having a sinusoidal curve in side elevation to conform to the general shape of the head and neck of the user. The aid is readily disassembled from an operable configuration to a storage configuration. The base is adapted for mounting on the back of a chair or for placement on a supporting surface.

1 Claim, 7 Drawing Figures

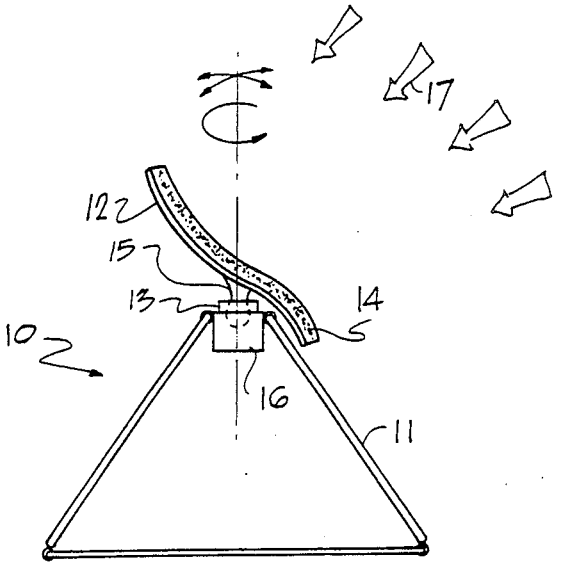
FIG. 1
FIG. 2
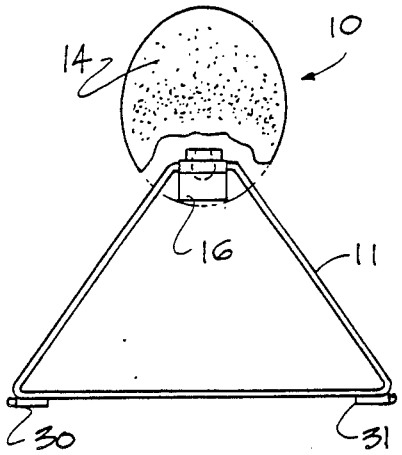
FIG. 3
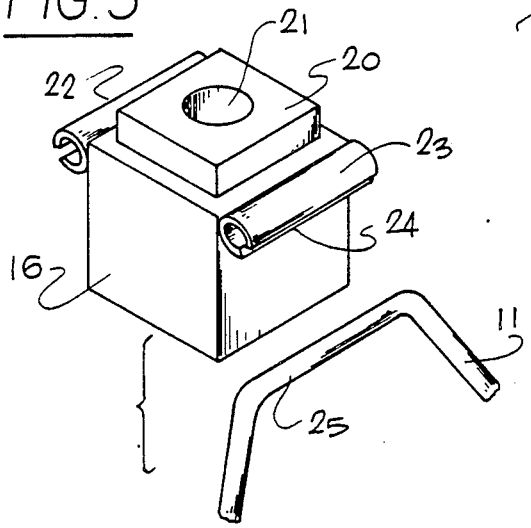
FIG. 4
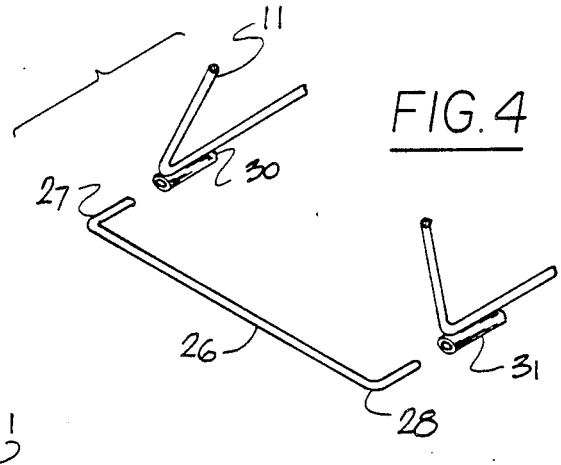
FIG. 6
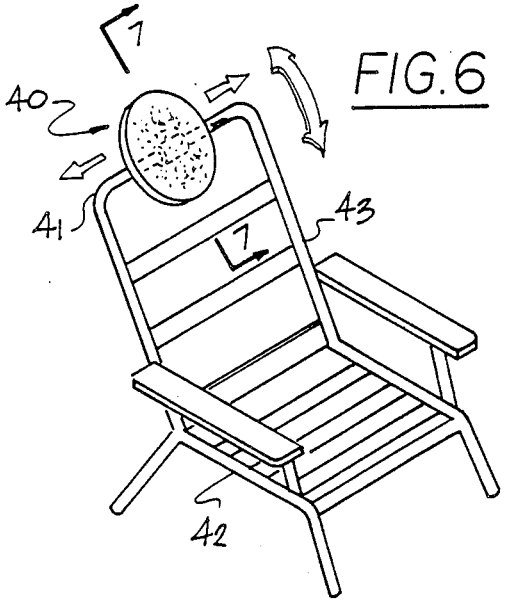
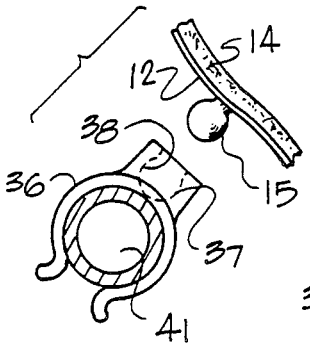
FIG. 7
FIG. 5
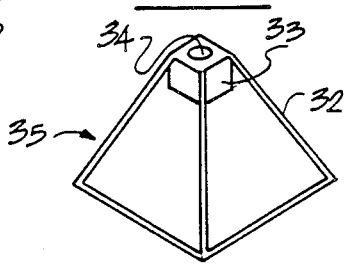

ADJUSTABLE HEADREST FOR SUNBATHERS

BACKGROUND OF THE INVENTION

1. Field of the Invention

The present invention relates to sunbathers' aids and more particularly to a headrest apparatus for sunbathers for use at a variety of recreational facilities such as pools, beaches, sundecks or the like so that the sunbather rests his head on the apparatus while receiving the beneficial effects of the sun's rays.

2. Brief Description of the Prior Art

In the past, it has been the usual practice for sunbathers to rest their heads on towels, mattresses, blankets, beach rests, chairs or the like while facing the sun so that the beneficial effects of the sun's rays can be received. However, problems and difficulties have been encountered when sunbathers use these conventional methods because the sunbather's face is not directly facing the sun in order to receive the direct rays. The problem is further compounded due to the fact that the sun is constantly moving and although the sunbather may feel that he is receiving the sun's rays from a certain direction, this may be inaccurate since the sun is moving and its position constantly changes. Therefore, the sunbather has to change his or her position and must rise from the resting means and relocate with respect to the position of the sun in order to gain the desired sun rays or, in the alternate, to avoid undesired sun rays.

Other problems have arisen which stem from the fact that conventional headrests for a person in a seated or prone position are uncomfortable and do not take into account the shape of the user's head or neck. So the headrests are very uncomfortable due to the lack of padding or cushioning material while other headrests are bulky, cumbersome and awkward to adjust or use.

Therefore, a longstanding need has existed to provide a novel headrest apparatus for sunbathing use which will readily conform to the general shape of the user's head and neck and which is universally mounted so as to be movable in order to follow the position of the sun.

SUMMARY OF THE INVENTION

Accordingly, the above problems and difficulties are obviated by the present invention which provides a novel headrest apparatus for supporting the head of a sunbather while receiving the beneficial effects of the sun's rays. The apparatus includes a stationary base having a universal means for movably supporting a headrest platform. The overall configuration or shape of the platform is such that it is conformal to the user's back of the head and neck and a cushioned layer is provided for user comfort. In one form of the invention, the shape of the platform is sinusoidal in side elevation and the apparatus is readily detachable in major component parts so as to be readily stored in a flat position or readily assembled in operative or use position. Means are provided for detachably connecting the headrest platform to the back of a chair so that the sunbather may use the apparatus in either a seated or prone position.

Therefore, it is among the primary objects of the present invention to provide a novel headrest or supporting apparatus which will readily support the head of the user so that the beneficial rays of the sun can be received while the sun is changing positions.

Another object of the present invention is to provide a novel headrest for a sunbather which is substantially conformal to the back of the head and neck of the user so as to provide maximum comfort and which is movable so as to follow the position of the sun during the course of many hours.

Yet another object of the present invention is to provide a novel sunbathers' headrest which is fully articulated and may be readily assembled and disassembled between an operative and a storage condition.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side elevational view of the novel headrest apparatus of the present invention illustrated in a position for receiving the direct rays of the sun as the sun changes positions;

FIG. 2 is a front elevational view of the sunbathers' sun apparatus shown in FIG. 1;

FIG. 3 is an enlarged perspective view of the universal joint means connecting the platform of the apparatus to the base of the apparatus;

FIG. 4 is an exploded perspective view of the base showing detachable means for bracing the base;

FIG. 5 is a reduced perspective view of another base including universal means for supporting the platform incorporating the present invention;

FIG. 6 is another version of the invention adapted for movably mounting the headrest to the back of a chair; and FIG. 7 is a transverse cross-sectional view of the apparatus shown in FIG. 6 as taken in the direction of arrows 7—7 thereof.

DESCRIPTION OF THE PREFERRED EMBODIMENT

Referring to FIG. 1, the novel sunbather's headrest of the present invention is illustrated in the general direction of arrow 10 which includes a base 11 for supporting a headrest platform 12 via a universal means 13. The platform includes a thickness of cushioning material 14 and the platform 12 is in a gentle sloping or curved shape or configuration in side elevation. This shape or configuration permits the platform to conform substantially to the general contour of the user's back of the head and neck. It is to be noted that the platform 12 includes a peg or post 15 having an enlarged end which is insertably received into a receptacle provided in a mounting block 16. It is to be noted that the post 15 is positioned closer to the lower end of the platform 12 as opposed to the upper end. Also, the post 15 provides a rotating axis about which the platform articulates so that a full universal movement is obtained. This permits the user to rotate the cushioned platform 12 with respect to the base 11 as the sun moves its position throughout the day or time period. The rays of the sun are indicated in general by the numeral 17.

It is further to be noted that the mounting block 16 is detachably connected to the base 11 and that the base 11 may be readily disassembled for storage purposes. In this connection, it can be seen in FIGS. 2–4 inclusive that the apparatus may be readily disassembled or assembled between a storage position and an operative position.

Referring now in detail to FIG. 3, it can be seen that the mounting block 16 includes a collar portion 20 having an opening 21 which is of reduced diameter as compared to a hole provided in the mount 16. Since the post 15 includes an enlarged terminating end, this latter end may be snap fitted through the opening 21 into the larger diametered hole in the mount 16 for retention purposes. The post 15 may now rotate or pivot within the confines of the hole 21 within the larger block 16.

The opposite sides of the mounting block include tubular retainers 22 and 23 which include elongated slots, such as slot 24 associated with retainer 23, adapted to insertably receive a rung 25 of the base 11. Each rung of the base 11 fits into the retainers 22 and 23 on opposite sides of the mounting block so as to elevate the mounting block and the platform 12 above the surface upon which the base is supported. By making the base tubular or from rods, the structure is light and yet will be readily inserted within the receivers 22 and 23 with little effort.

Referring now in detail to FIG. 4, it can be seen that the bottom of the base is rigidized by means of bracing members such as member 26 having opposite ends 27 and 28 that are insertably received into retainers 30 and 31 carried on the bottom of the base 11.

Referring now in detail to FIG. 5, another version of the invention is illustrated which includes a fixed base 32 for supporting a mounting block 33 which includes an opening 34 leading into an enlarged hole in the block. The platform 12 and post 15 are used in the manner previously described. However, in the version indicated by numeral 35, the base is rigid and it is not possible to disassemble the base as described with respect to FIGS. 3 and 4.

Referring to FIGS. 6 and 7, still another embodiment or version of the invention is illustrated wherein the platform 12 and its post 15 is detachably mounted and carried on a clip fixture 36. The clip 36 includes an enlarged portion 37 having a shaped hole 38 for receiving the enlarged end of post 15. Preferably, the portion 37 of the clip is composed of a resilient plastic material so that the post may be snap fitted through the reduced opening of the hole 38 into the major area of the hole.

As shown in FIG. 6, the embodiment 40 is carried on the upper rail or support bar 41 of a conventional chair 42. The bar 41 is on the upper end of the chair back 43 and the apparatus 40 may be disposed anywhere along the length of the bar 40 as indicated by the arrows. Also, the platform is fully articulated so that the platform may move in a pivoting manner fore and aft on bar 41 by means of the clip sliding thereover. This relationship is shown more clearly in FIG. 7 where it can be seen that the clip 36 includes resilient legs which snap fit over the bar 41. However, the clip can be rotated on the bar to position the headrest.

In view of the foregoing, it can be seen that the device of the present invention provides a novel headrest which is convenient for the sunbather to use in order to obtain the direct benefit of the sun's rays. The position of the sun may be readily followed by the articulating movement of the platform by the user whether the platform be mounted on the knock-down base 11, fixed base 32 or the chair base bar 41.

While particular embodiments of the present invention have been shown and described, it will be obvious to those skilled in the art that changes and modifications may be made without departing from this invention in its broader aspect, and, therefore, the aim in the appended claims is to cover all such changes and modifications as fall within the true spirit and scope of this invention.

I claim:

1. A sunbather's headrest comprising:

a base;

a platform for supporting the head of a user;

means carried on said base for movably mounting said platform on said base;

said base includes a broad lower portion and an apex upper portion;

said mounting means secured to said apex upper portion;

said mounting means includes a block fixed to said apex upper portion having an enlarged hole therein;

said platform having a post carried on its underside having an enlarged terminating end adapted to be insertably received into said block hole;

retaining means carried on said block for detachably connecting with said base;

said base comprising a pair of triangular end pieces joined at their apex upper portions by said mounting block; and said lower portions joined together by detachable brace members.

* * * * *